US008746826B2

(12) United States Patent
Kim et al.

(10) Patent No.: US 8,746,826 B2
(45) Date of Patent: Jun. 10, 2014

(54) DEVICE AND METHOD FOR MANAGING PIEZO INKJET HEAD

(75) Inventors: Byung Hun Kim, Gyeonggi-do (KR); Hyun Seok Lee, Seoul (KR)

(73) Assignee: Samsung Electro-Mechanics Co., Ltd., Gyunggi-Do (KR)

( * ) Notice: Subject to any disclaimer, the term of this patent is extended or adjusted under 35 U.S.C. 154(b) by 113 days.

(21) Appl. No.: 13/448,233

(22) Filed: Apr. 16, 2012

(65) Prior Publication Data

US 2012/0293576 A1 Nov. 22, 2012

(30) Foreign Application Priority Data

May 16, 2011 (KR) ..... 10-2011-0045735

(51) Int. Cl.
*B41J 29/38* (2006.01)

(52) U.S. Cl.
USPC ..... 347/10; 347/5; 347/9; 347/11

(58) Field of Classification Search
CPC ..... B41J 29/38; B41J 2/175; B41J 2/125
See application file for complete search history.

(56) References Cited

U.S. PATENT DOCUMENTS 5,854,645 A * 12/1998 Witteveen et al. ..... 347/68
7,090,323 B2 * 8/2006 Takatsuka ..... 347/17
2007/0008357 A1 * 1/2007 Min et al. ..... 347/11
2012/0062629 A1 * 3/2012 Kim et al. ..... 347/10
2012/0218333 A1 * 8/2012 Nishikawa ..... 347/10

FOREIGN PATENT DOCUMENTS

JP 2004276366 * 10/2004 ..... B41J 2/01
KR 10-2004-0077560 A 9/2004
KR 20100130415 * 12/2010 ..... B41J 2/045

OTHER PUBLICATIONS

Samsung Electro-Mechanics Co.,Ltd., Office Action dated Jan. 4, 2013 in Korean Application No. 10-2011-0045735.

* cited by examiner

*Primary Examiner* — Manish S Shah
*Assistant Examiner* — Jeremy Delozier
(74) *Attorney, Agent, or Firm* — Bracewell & Giuliani LLP; Brad Y. Chin

(57) ABSTRACT

A device and a method for managing a piezo inkjet head. The device includes: a piezo actuator connected to an inkjet head to generate pressure; a driver that controls driving of the piezo actuator; a sensing resistor connected between the driver and the piezo actuator, a signal amplifier connected across the sensing resistor to amplify the signal applied to the sensing resistor; a signal processor that removes noise of the signal output from the signal amplifier; a controller that determines a signal passing through the signal processor as a reference signal in a state in which bubbles are not introduced into the inkjet head; and a storage unit that stores the signal determined as the reference signal in the controller. The controller calculates a difference between the signal passing through the signal processor and the reference signal to generate a detection signal and determine a state of the inkjet head.

11 Claims, 3 Drawing Sheets

DEVICE AND METHOD FOR MANAGING PIEZO INKJET HEAD

CROSS REFERENCE(S) TO RELATED APPLICATIONS

This application claims the benefit under 35 U.S.C. Section 119 of Korean Patent Application Serial No. 10-2011-0045735, entitled "Device and Method for Managing Piezo Inkjet Head" filed on May 16, 2011, which is hereby incorporated by reference in its entirety into this application.

BACKGROUND OF THE INVENTION

1. Technical Field

The present invention relates to a device and a method for managing a piezo inkjet head.

2. Description of the Related Art

Generally, a piezo inkjet head includes a pressure chamber, a nozzle, a passage, and a piezo actuator generating driving pressure. The piezo actuator is generally attached closely around the pressure chamber and may discharge an ink droplet from the nozzle by generating pressure according to a change in displacement in the piezo actuator.

In this configuration, the nozzle part of the inkjet head is exposed to air, such that air is easily introduced into the inkjet head at a contacting surface of ink and air. The introduced air significantly reduces the pressure generated from the deformation of the piezo actuator, thereby stopping the discharge of the droplet from the nozzle.

Meanwhile, the related art uses a method of confirming the state of the nozzle as described above using a CCD camera or a method of confirming the state of the nozzles by the naked eyes through simple printing.

However, when the CCD camera is used, there are problems in that additional components such as a CCD device, a lens, or the like, need to be attached to a printer and a considerable amount of time in determining whether all the nozzles are abnormal is consumed when there are a large number of heads.

Further, even when simple printing is used, there is a problem in that a printer operator needs to confirm the presence and absence of discharge.

SUMMARY OF THE INVENTION

An object of the present invention is to provide a device and a method for managing a piezo inkjet head capable of determining whether the piezo inkjet head is abnormal and managing the same.

According to an exemplary embodiment of the present invention, there is provided a device for managing a piezo inkjet head, including: a piezo actuator that is connected to an inkjet head to generate pressure; a driver that controls driving of the piezo actuator; a controller that determines a signal generated from the piezo actuator as a reference signal in a state in which bubbles are not introduced into the inkjet head; and a storage unit that stores the signal determined as the reference signal in the controller.

The controller may calculate a difference between the signal generated from the piezo actuator and the reference signal stored in the storage unit to generate a detection signal and determines a state of the inkjet head according to whether an amplitude and/or a frequency of the detection signal is in a predetermined range.

The controller may further include a display unit that displays the results of determining the state of each inkjet head by the controller.

The controller may calculate the frequency of the detection signal by dividing a temporal length of the generated detection signal by the number of times when a phase of the detection signal is changed from a positive number to a negative number or from a negative number to a positive number.

According to an exemplary embodiment of the present invention, there is provided a method for managing a piezo inkjet head including an inkjet head, a piezo actuator, a driver, and a sensing resistor, the method including: (a) receiving a signal generated from the piezo actuator immediately after ink is discharged from the inkjet head; (b) comparing the received signal at step (a) with a reference signal generated from the piezo actuator in a state in which bubbles are not introduced into the inkjet head and calculating the difference therebetween to generate a detection signal; (c) comparing an amplitude of the detection signal with a predetermined threshold amplitude to determine that the piezo inkjet head is in an abnormal state if it is determined that the amplitude of the detection signal is larger than the threshold amplitude; and (d) determining that the piezo inkjet head is in an abnormal state when a frequency of the detection signal is in a range of a predetermined frequency and determines that the piezo inkjet head is a normal state when the frequency of the detection signal is out of the range of the predetermined frequency, if it is determined that the amplitude of the detection signal at step (c) is smaller than the threshold amplitude.

The method for managing a piezo inkjet head may further include displaying an abnormal state by using a separate display unit if it is determined that the piezo inkjet head is in an abnormal state at steps (c) and/or (d).

The method for managing a piezo inkjet head may further include cleaning nozzles if it is determined that the piezo inkjet head is in an abnormal state at steps (c) and/or (d).

At step (d), the frequency of the detection signal may be calculated by dividing a temporal length of the detection signal by the number of times when a phase of the detection signal is changed from a positive number to a negative number or from a negative number to a positive number.

According to an exemplary embodiment of the present invention, there is provided a method for managing a piezo inkjet head including an inkjet head, a piezo actuator, a driver, and a sensing resistor, the method including: receiving a signal generated from the piezo actuator immediately after ink is discharged from the inkjet head; comparing the received signal with a reference signal generated from the piezo actuator in a state in which bubbles are not introduced into the inkjet head and calculating the difference therebetween to generate a detection signal; and determining that the piezo inkjet head is in an abnormal state when a frequency of the detection signal is in a predetermined frequency and determining that the piezo inkjet head is a normal state when the frequency of the detection signal is out of the range of the predetermined frequency.

The frequency of the detection signal may be calculated by dividing a temporal length of the detection signal by the number of times when a phase of the detection signal is changed from a positive number to a negative number or from a negative number to a positive number.

DESCRIPTION OF THE PREFERRED EMBODIMENTS

Figure 1:
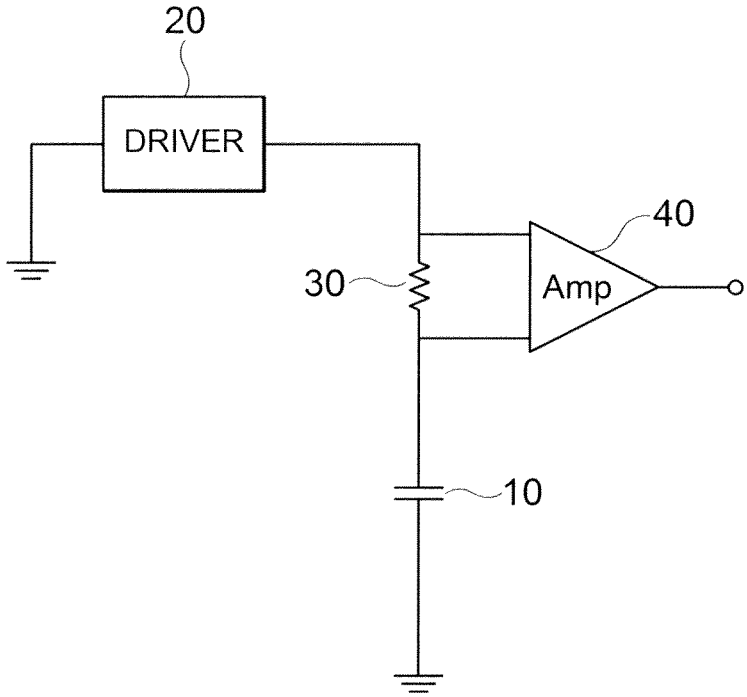
FIG. 1 is a diagram schematically showing a part of a device for managing a piezo inkjet head according to an exemplary embodiment of the present invention.

Advantages and characteristics of the present invention, and a method for achieving them will be apparent with reference to embodiments described below in addition to the accompanying drawings. However, the present invention is not limited to the embodiments disclosed below, but may be implemented in various forms. The embodiments may be provided to completely disclose the present invention and allow those skilled in the art to completely know the scope of the present invention. Throughout the specification, like elements refer to like reference numerals.

Terms used in the specification are used to explain the embodiments and not to limit the present invention. In the specification, singular type may also be used as a plural type unless stated specifically. "Comprises" and/or "comprising" used the specification mentioned constituent members, steps, operations and/or elements do not exclude the existence or addition of one or more other components, steps, operations and/or elements.

Hereinafter, a configuration and an operation of exemplary embodiments of the present invention will be described in more detail with reference to the accompanying drawings.

FIG. 1 is a diagram schematically showing a part of a device for managing a piezo inkjet head according to an exemplary embodiment of the present invention. Referring to FIG. 1, a piezo actuator 10 may discharge droplets from an inkjet head while the displacement of the piezo actuator is changed according to a signal generated from a driver 20.

In this configuration, when an electrical signal generated by vibrations of the piezo actuator 10 is applied to a sensing resistor 30 disposed between the driver 20 and the piezo actuator 10 after an ink droplet is discharged, it is determined whether the piezo inkjet head is abnormal by amplifying the signal applied to the sensing resistor 30 and using the amplified signal. That is, the piezo actuator 10 may be used to monitor a discharge state.

Figure 2A:
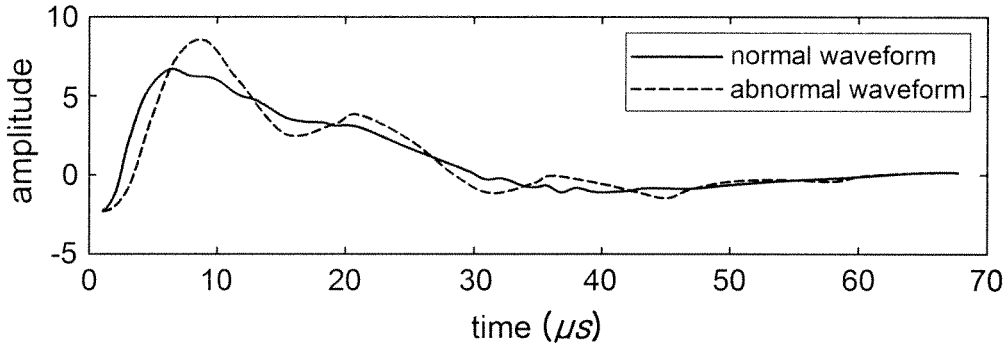
FIG. 2A is a graph showing a signal waveform in a normal state and a signal waveform in an abnormal state that are generated from the piezo inkjet head and FIG. 2B is a graph showing a difference value between a normal waveform and an abnormal waveform.
Figure 2B:
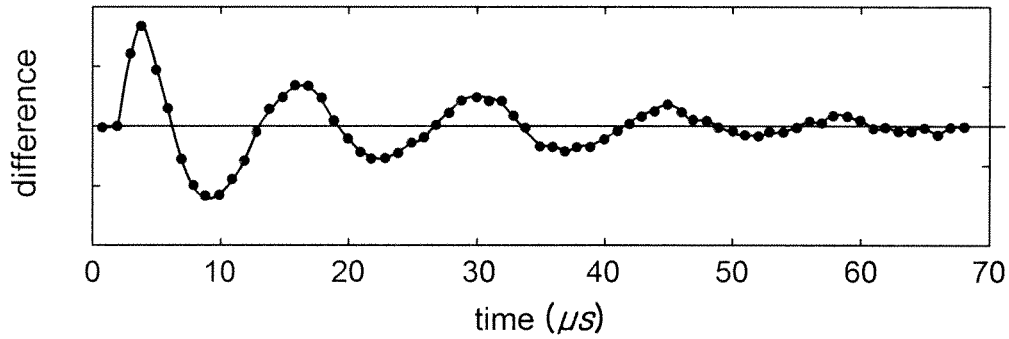

FIG. 2A is a graph showing a signal waveform in the normal state and a signal waveform in the abnormal state that are generated from the piezo inkjet head and FIG. 2B is a graph showing a difference value between the normal waveform and the abnormal waveform.

Referring to FIG. 2A, when the piezo inkjet head is in the normal state, a waveform in a type like a solid line is detected. However, when the abnormal state such as the introduction of bubbles into the piezo inkjet head, or the like, occurs, a waveform generated like a dotted line is detected.

Meanwhile, when the abnormal waveform is excluded from the normal waveform, a graph as shown in FIG. 2B may be obtained.

The device for managing a piezo inkjet head according to the exemplary embodiment of the present invention may determine whether the piezo inkjet head is abnormal by using a signal waveform shown in FIG. 2B.

Figure 3:
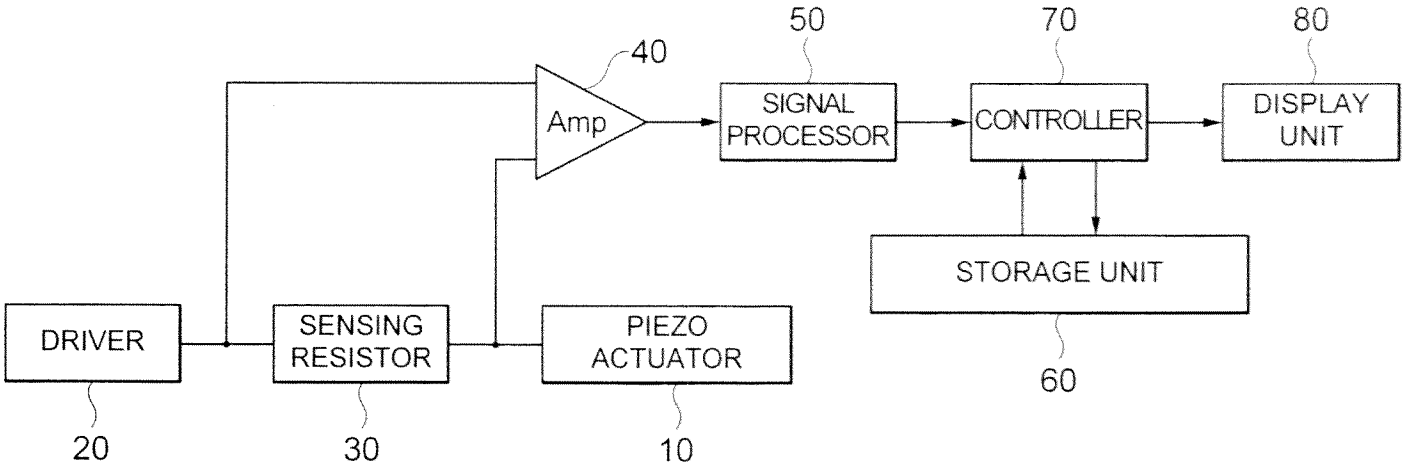
FIG. 3 is a diagram schematically showing the device for managing a piezo inkjet head according to the exemplary embodiment of the present invention.

FIG. 3 is a diagram schematically showing the device for managing a piezo inkjet head according to the exemplary embodiment of the present invention.

Referring to FIG. 3, the device for managing a piezo inkjet head according to the exemplary embodiment of the present invention may include the piezo actuator 10, the driver 20, the sensing resistor 30, a signal amplifier 40, a signal processor 50, a controller 70, and a storage unit 60.

The piezo actuator 10 may be connected to the inkjet head (not shown) to serve to generate pressure.

The driver 20 may serve to control the driving of the piezo actuator 10.

The piezo actuator 10 and the driver 20 are prevalently used for the inkjet head in a general piezo type and therefore, the detailed description thereof will be omitted.

The sensing resistor 30 may be connected between the driver 20 and the piezo actuator 10 and may receive the electrical signal generated from the piezo actuator 10.

The signal amplifier 40 may serve to amplify the electrical signal applied to the sensing resistor 30.

After the ink is discharged from the piezo inkjet head, current generated from the piezo actuator 10 is much smaller than current used at the time of driving the piezo actuator 10, due to a pressure wave. Therefore, in order to determine the head state by using the piezo actuator 10 as a monitor, the signal generated from the piezo actuator 10 may be processed by separate processes.

Therefore, the signal that is generated from the piezo actuator 10 and received through the sensing resistor 30 may be amplified by the signal amplifier 40. As the signal amplifier 40, various types of amplifiers may be used.

Meanwhile, when the signal is amplified using the signal amplifier 40, noise, DC offset, or the like, may occur. The noise or the DC offset may degrade the reliability of determination on whether the piezo inkjet head is abnormal.

Therefore, the device for managing a piezo inkjet head according to the exemplary embodiment of the present invention may include the signal processor 50.

The noise or the DC offset included in the amplified signal in the signal amplifier 40 may be removed by using the signal processor 50. In this case, the signal processor 50 may be implemented by various filters, or the like.

The storage unit 60 may store the signal passing through the signal amplifier 40 and/or the signal processor 50.

The controller 70 may serve to differentiate the signal passing through the signal amplifier 40 and/or the signal processor 50 into the normal or abnormal signal.

Describing in detail, first, the signal passing through the signal processor 50 may be differentiated as a reference signal by the controller 70 in the state in which bubbles are not introduced into the inkjet head.

For example, it can be confirmed that the signal is in the normal state while monitoring printed matters at the initial stage where the ink is introduced into the inkjet head and is then discharged by the naked eyes. In this case, the signal detected in the state in which the discharging temporarily stops may be defined as a reference signal.

Signal data determined as the reference signal by the controller 70 are stored in the storage unit 60 and may be used as reference data during a subsequent determination process.

Next, the controller 70 may generate a detection signal by calculating a difference between the signal passing through the signal amplifier 40 and/or the signal processor 50 and the reference signal stored in the storage unit 60.

In this case, the signal waveform shown in FIG. 2B may be an example of the detection signal.

Next, the controller 70 may calculate an amplitude and a frequency of the detection signal.

In this case, an obtained root mean square (RMS) value of the detection signal may be used instead of the amplitude of the detection signal.

In addition, the frequency of the detection signal may be calculated by a fast Fourier transform (FFT) type or a zero crossing (ZC) type.

However, since the detection signal is formed to have a relatively short length, the ZC type may be more preferable than the FFT type.

The ZC type may count the number of times when the signal crosses a zero point and divides the length of the signal by the counted number, thereby measuring the period or the frequency of the signal.

Figure 4:
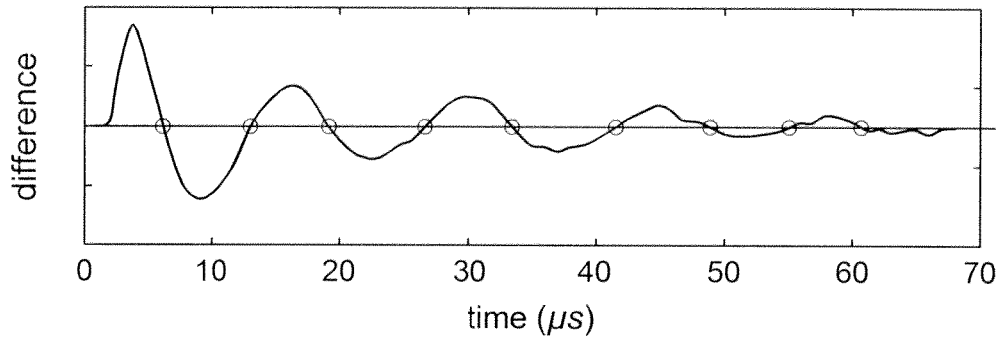
FIG. 4 is a diagram showing a principle of measuring a frequency in the device for managing a piezo inkjet head according to the exemplary embodiment of the present invention.

FIG. 4 is a diagram showing a principle of measuring a frequency in the device for managing a piezo inkjet head according to the exemplary embodiment of the present invention. Referring to FIG. 4, the controller 70 may calculate the frequency of the detection signal by a method of dividing a temporal length of the generated detection signal by the number of times when a phase of the detection signal is changed from a positive number to a negative number or from a negative number to a positive number.

Next, the controller 70 determines whether the amplitude of the detection signal is in a range that may be viewed as the normal state, thereby determining whether the piezo inkjet head is the normal state or the abnormal state.

When the piezo inkjet head is in the normal state, the amplitude of the detection signal is smaller than a specific value (hereinafter, referred to as "threshold amplitude").

In this case, the threshold amplitude that becomes a boundary between the normal state and the abnormal state may be changed according to the discharge reliability requested by manufacturers.

Further, when the piezo inkjet head is in the abnormal state, the amplitude of the detection signal is larger than the threshold amplitude. Therefore, it may determine whether the piezo inkjet head is in the normal state or the abnormal state by comparing the amplitude of the detection signal with the threshold amplitude in the controller 70.

Next, the controller 70 determines whether the frequency of the detection signal is in a range that may be viewed as the abnormal state, thereby determining whether the piezo inkjet head is in the abnormal state.

As the experimental results, when the piezo inkjet head is in the abnormal state, it may be confirmed that the frequency of the detection signal is in the specific range. In addition, if it is determined that the frequency of the detection signal is not in the specific range, it is confirmed that the piezo inkjet head is in the normal state.

In this case, a lower bound and an upper bound of the frequency range may be varied according to conditions such as a diameter and a length of a passage of the inkjet head, a type of ink, or the like. Further, the frequency of the detection signal may be calculated according to the above-mentioned ZC type.

The upper bound and the lower bound of the threshold amplitude and/or the frequency range of the detection signal in the abnormal state may be stored in the storage unit 60 in a data form.

Meanwhile, the device for managing a piezo inkjet head may further include a display unit 80 that displays the normal or abnormal state determined in the controller 70 and may include a separate unit, such as a maintenance unit cleaning nozzles determined as the abnormal state, or the like.

Figure 5:
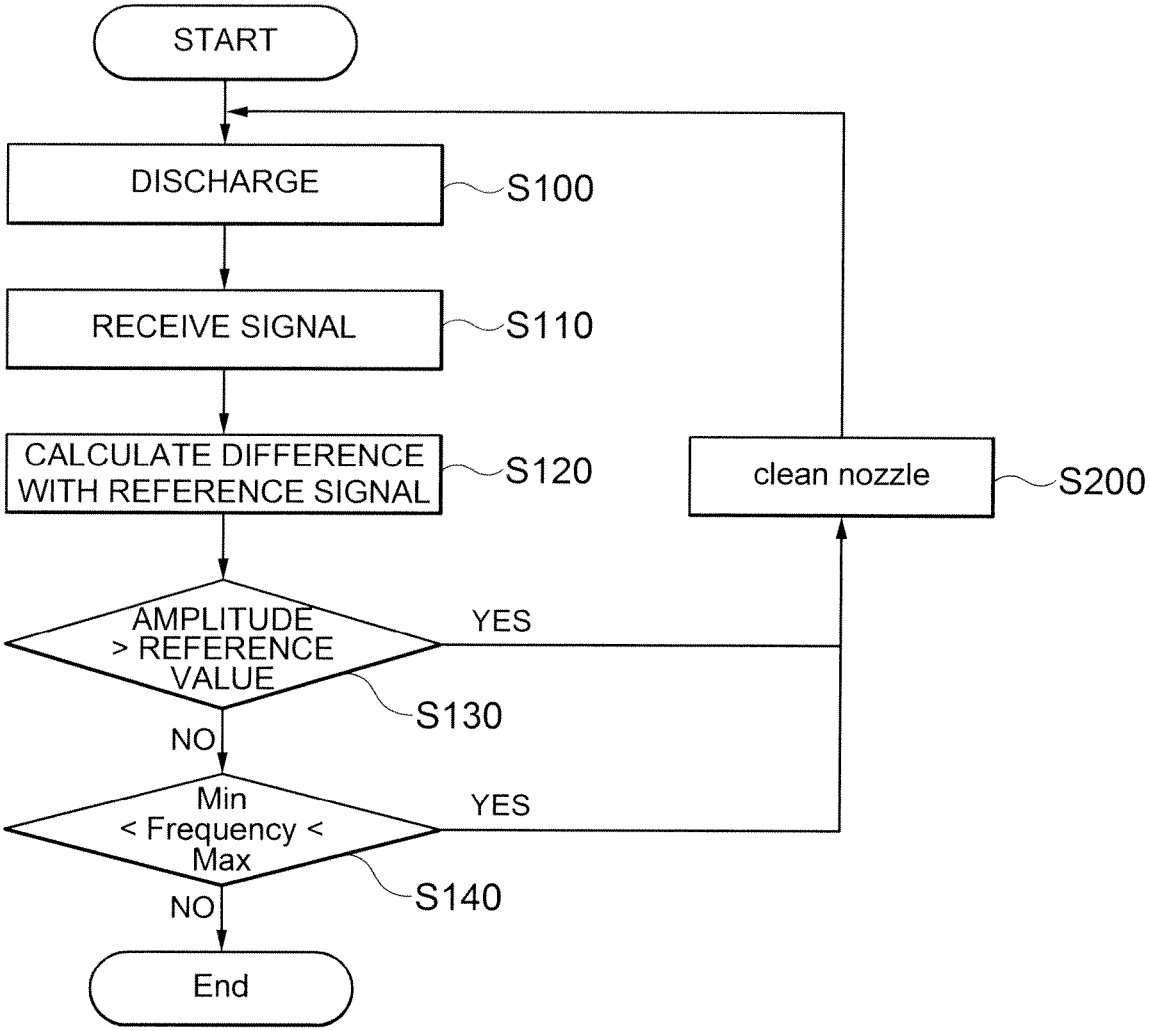
FIG. 5 is a flow chart showing a method for managing a piezo inkjet head according to the exemplary embodiment of the present invention.

FIG. 5 is a flow chart showing a method for managing a piezo inkjet head according to the exemplary embodiment of the present invention. The method for managing a piezo inkjet head according to the exemplary embodiment of the present invention will be described below with reference to FIG. 5.

The method for managing a piezo inkjet head according to the exemplary embodiment of the present invention relates to a method for managing a piezo inkjet head that includes the inkjet head, the piezo actuator 10, the driver 20, and the sensing resistor 30.

The method for managing a piezo inkjet head according to the exemplary embodiment of the present invention may be largely classified into receiving the signal, generating the detection signal by comparing the received signal with the reference signal, and determining the piezo inkjet head by using the amplitude and/or the frequency of the detection signal.

First, the receiving of the signal receives (S110) a signal generated from the piezo actuator 10 immediately after the ink is discharged from the inkjet head (S100).

Next, the detection signal is generated by comparing the received signal with the reference signal generated from the piezo actuator 10 in the state in which the bubbles are not introduced into the inkjet head and calculating the difference (S120).

The reference signal may be the received signal obtained by electrical signal passing through the sensing resistor 30, the signal amplifier 40 and/or the signal processor 50 and then received in the controller 70 in the state in which the bubbles are not introduced into the inkjet head.

The controller 70 may differentiate the signal as the reference signal.

For example, it can be confirmed that the signal is in the normal state while monitoring printed matters at the initial stage where the ink is introduced into the inkjet head and is then discharged by the naked eyes. In this case, the signal detected in the state in which the discharging temporarily stops may be defined as a reference signal.

The signal data determined as the reference signal by the controller 70 are stored in the storage unit 60 and may be used as the reference data during the subsequent determination process.

The detection signal according to the difference obtained by comparing the received signal with the reference signal is generated. In this case, a representative example of the detection signal is shown in FIG. 2B.

Next, the case in which the amplitude of the detection signal is larger than the threshold amplitude by comparing the amplitude of the detection signals with the predetermined threshold amplitude may be determined as the abnormal state (S130).

In this case, the root mean square (RMS) value of the detection signal may be used instead of the amplitude of the detection signal.

When the piezo inkjet head is in the normal state, the amplitude of the detection signal is smaller than a specific value (hereinafter, referred to as "threshold amplitude").

In this case, the threshold amplitude that becomes a boundary between the normal state and the abnormal state may be changed according to the discharge reliability requested by manufacturers.

Further, when the piezo inkjet head is the abnormal state, the amplitude of the detection signal is larger than the threshold amplitude. Therefore, it may be determined whether the piezo inkjet head is the normal state or the abnormal state by comparing the amplitude of the detection signal with the threshold amplitude in the controller 70.

Meanwhile, the controller 70 determines whether the frequency of the detection signal is in a range that may be viewed as a abnormal state, thereby determining whether the piezo inkjet head is the abnormal state (S140).

In addition, the frequency of the detection signal may be calculated by a fast Fourier transform (FFT) type or a zero crossing (ZC) type.

However, since the detection signal is formed to have a relatively short length, the ZC type may be more preferable than the FFT type.

The ZC type may count the number of times when the signal crosses a zero point and divides the length of the signal by the counted number, thereby measuring the period or the frequency of the signal.

FIG. 4 is a diagram showing a principle of measuring a frequency in the device for managing a piezo inkjet head according to the exemplary embodiment of the present invention. Referring to FIG. 4, the controller 70 may calculate the frequency of the detection signal by a method of dividing the temporal length of the generated detection signal by the number of times when a phase of the detection signal is changed from a positive number to a negative number or from a negative number to a positive number.

As the experimental results, when the piezo inkjet head is the abnormal state, it may be confirmed that the frequency of the detection signal is in the specific range. In addition, if it is determined that the frequency of the detection signal is not in the specific range, it is confirmed that the piezo inkjet head is the normal state.

In this case, the lower bound and the upper bound of the frequency range may be varied according to the conditions such as the diameter and the length of the passage of the inkjet head, the type of ink, or the like. Further, the frequency of the detection signal may be calculated according to the above-mentioned ZC type.

Meanwhile, when the piezo inkjet head is determined as the abnormal state by the amplitude comparison of the detection signal or is determined as the abnormal state by the frequency comparison of the detection signal, the abnormal state may be displayed using the separate display unit 80.

In addition, when the piezo inkjet head is determined as the abnormal state by the amplitude comparison of the detection signal or is determined as the abnormal state by the frequency comparison of the detection signal, the nozzles determined as the abnormal state using the separate unit may be cleaned (S200).

In addition, if it is determined that the piezo inkjet head is not abnormal, a normal printing process may be performed.

Meanwhile, FIG. 5 shows a method of determining the state of the piezo inkjet head by comparing the amplitude with the threshold amplitude and then performing the determination of the frequency if it is determined that the piezo inkjet head is normal. As shown in FIG. 5, if the abnormal state is determined by performing the amplitude comparison and then performing the frequency comparison, the reliability of determination on whether the piezo inkjet head is abnormal may be improved.

In addition, unlike one shown in FIG. 5, it may be determined whether the piezo inkjet head is abnormal by immediately performing only the frequency comparison without performing the comparison process of the amplitude.

As set forth above, the exemplary embodiment of the present invention provides useful effects that can determine whether the piezo inkjet head is abnormal and take measures thereon in real time.

Further, the exemplary embodiment of the present invention can improve the precision of determination on whether the piezo inkjet head is abnormal.

The above detailed description exemplifies the present invention. Further, the above contents just illustrate and describe preferred embodiments of the present invention and the present invention can used under various combinations, changes, and environments. That is, it will be appreciated by those skilled in the art that substitutions, modifications and changes may be made in these embodiments without departing from the principles and spirit of the general inventive concept, the scope of which is defined in the appended claims and their equivalents. Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Therefore, the detailed description of the present invention does not intend to limit the present invention to the disclosed embodiments. Further, it should be appreciated that the appended claims include even another embodiment.

What is claimed is:

1. A device for managing a piezo inkjet head, comprising:

a piezo actuator that is connected to an inkjet head to generate pressure;

a driver that controls a driving of the piezo actuator;

a controller that determines a signal generated from the piezo actuator as a reference signal in a state in which bubbles are not introduced into the inkjet head; and a storage unit that stores the signal determined as the reference signal in the controller, wherein the controller calculates a difference between the signal generated from the piezo actuator and the reference signal stored in the storage unit to generate a detection signal and determines a state of the inkjet head according to whether amplitude and/or a frequency of the detection signal is in a predetermined range, and wherein the controller calculates the frequency of the detection signal by dividing a temporal length of the generated detection signal by the number of times when a phase of the detection signal is charged from a positive number to a negative number or from a negative number to a positive number.

2. The device according to claim 1, further comprising:

a sensing resistor that is connected between the driver and the piezo actuator, wherein the controller determines a signal applied to the sensing resistor as a reference signal in the state in which the bubbles are not introduced into the inkjet head, calculates a difference between the signal applied to the sensing resistor and the reference signal stored in the storage unit to generate the detection signal, and determines the state of the inkjet head according to whether the amplitude and/or the frequency of the detection signal is in a predetermined range.

3. The device according to claim 2, further comprising:

a signal amplifier that is connected across the sensing resistor to amplify the signal applied to the sensing resistor, wherein the controller determines a signal passing through the signal amplifier as the reference signal in the state in which the bubbles are not introduced into the inkjet head, calculates the difference between the signal passing through the signal amplifier and the reference signal stored in the storage unit to generate the detection signal, and determines the state of the inkjet head according to whether the amplitude and/or the frequency of the detection signal is in the predetermined range.

4. The device according to claim 3, further comprising:

a signal processor that removes noise of the signal output from the signal amplifier, wherein the controller determines a signal passing through the signal processor as the reference signal in the state in which the bubbles are not introduced into the inkjet head, calculates the difference between the signal passing through the signal processor and the reference signal stored in the storage unit to generate the detection signal, and determines the state of the inkjet head according to whether the amplitude and/or the frequency of the detection signal is in the predetermined range.

5. The device according to claim 1, further comprising:

a display unit that displays the results of determining the state of each inkjet head by the controller.

6. A method for managing a piezo inkjet head including an inkjet head, a piezo actuator, a driver, and a sensing resistor, the method comprising:

(a) receiving a signal generated from the piezo actuator immediately after ink is discharged from the inkjet head;

(b) comparing the received signal at step (a) with a reference signal generated from the piezo actuator in a state in which bubbles are not introduced into the inkjet head and calculating the difference therebetween to generate a detection signal;

(c) comparing an amplitude of the detection signal with a predetermined threshold amplitude to determine that the piezo inkjet head is in an abnormal state if it is determined that the amplitude of the detection signal is larger than the threshold amplitude; and (d) determining that the piezo inkjet head is in an abnormal state when a frequency of the detection signal is in a range of a predetermined frequency and determines that the piezo inkjet head is in a normal state when the frequency of the detection signal is out of the range of the predetermined frequency, if it is determined that the amplitude of the detection signal at step (c) is smaller than the threshold amplitude, wherein at step (d), the frequency of the detection signal is calculated by dividing a temporal length of the detection signal by the number of times when a phase of the detection signal is changed from a positive number to a negative number or from a negative number to a positive number.

7. The method according to claim 6, wherein step (a) amplifies and receives the signal generated from the piezo actuator, and step (b) compares the received signal at step (a) with the reference signal generated from the piezo actuator with a reference signal amplifying the signal generated from the piezo actuator in a state in which the bubbles are not introduced into the inkjet head and calculate the difference therebetween to generate the detection signal.

8. The method according to claim 6, wherein step (a) amplifies the signal generated from the piezo actuator and removes noise and/or DC offset from the amplified signal and then receives the amplified signal, and step (b) compares the received signal at step (a) with the reference signal amplifying the signal generated from the piezo actuator in the state in which the bubbles are not introduced into the inkjet head and removing the noise and/or the DC offset and calculates the difference therebetween to generate the detection signal.

9. The method according to claim 6, further comprising:

displaying an abnormal state by using a separate display unit if it is determined that the piezo inkjet head is in an abnormal state at steps (c) and/or (d).

10. The method according to claim 6, further comprising:

cleaning nozzles if it is determined that the piezo inkjet head is in an abnormal state at steps (c) and/or (d).

11. A method for managing a piezo inkjet head including an inkjet head, a piezo actuator, a driver, and a sensing resistor, the method comprising:

receiving a signal generated from the piezo actuator immediately after ink is discharged from the inkjet head;

comparing the received signal with a reference signal generated from the piezo actuator in a state in which bubbles are not introduced into the inkjet head and calculating the difference therebetween to generate a detection signal; and determining that the piezo inkjet head is in an abnormal state when a frequency of the detection signal is in a range of a predetermined frequency and determining that the piezo inkjet head is in a normal state when the frequency of the detection signal is out of the range of the predetermined frequency, wherein the frequency of the detection signal is calculated by dividing, a temporal length of the detection signal by the number of times when the phase of the detection signal is changed from a positive number to a negative number or from a negative number to a positive number.

* * * * *